US012502596B2

(12) United States Patent
Arjanne et al.

(10) Patent No.: US 12,502,596 B2
(45) Date of Patent: Dec. 23, 2025

(54) SKI OR SNOWSHOE BINDING

(71) Applicant: OAC Finland Oy, Kangasala (FI)

(72) Inventors: Henri Arjanne, Tampere (FI); Miika Vuorio, Kaivanto (FI); Antti-Jussi Tiitola, Kaivanto (FI)

(73) Assignee: OAC FINLAND OY, Kangasala (FI)

( * ) Notice: Subject to any disclaimer, the term of this patent is extended or adjusted under 35 U.S.C. 154(b) by 194 days.

(21) Appl. No.: 18/547,666

(22) PCT Filed: Feb. 21, 2022

(86) PCT No.: PCT/FI2022/050113

§ 371 (c)(1),
(2) Date: Aug. 23, 2023

(87) PCT Pub. No.: WO2022/180303

PCT Pub. Date: Sep. 1, 2022

(65) Prior Publication Data

US 2024/0131415 A1 Apr. 25, 2024
US 2024/0226705 A9 Jul. 11, 2024

(30) Foreign Application Priority Data

Feb. 24, 2021 (FI) ..... U20210025

(51) Int. Cl.
*A63C 13/00* (2006.01)
*A63C 9/00* (2012.01)
*A63C 9/22* (2012.01)

(52) U.S. Cl.
CPC ..... *A63C 13/001* (2013.01); *A63C 9/002* (2013.01); *A63C 9/22* (2013.01)

(58) Field of Classification Search
CPC ..... A63C 13/001; A63C 9/002; A63C 9/22; A63C 10/06; A63C 10/045
See application file for complete search history.

(56) References Cited

U.S. PATENT DOCUMENTS 4,720,928 A 1/1988 Faber
5,259,128 A * 11/1993 Howell ..... A44B 11/14 24/200

(Continued)

FOREIGN PATENT DOCUMENTS

DE 102014000830 A1 * 3/2015 ..... A63C 17/262
FR 2774302 A1 * 8/1999 ..... A63C 10/06

(Continued)

OTHER PUBLICATIONS

FR-2818156-A1 English Translation (Year: 2002).*

(Continued)

*Primary Examiner* — Michael T. Walsh
(74) *Attorney, Agent, or Firm* — Christopher R. Carroll; The Small Patent Law Group LLC

(57) ABSTRACT

The proposed solution relates to a ski or snowshoe binding, to which binding a normal boot is attachable with general attachments which are part of said binding, such as with a strap in a front part of the binding and with a strap arrangement in a back part of the binding. The strap of the front part of the binding is transverse to the binding, adjustable in length and extends in a toe part of the binding under the body or inside the body of the binding. The cross-sectional profiles of the strap of the front part have been made in such a way that as the strap comes out from the body and turns upwards, a first profile portion is, in this region, in a direction of width at its narrowest substantially in the entire upward turn, after which a second profile portion is widening and thinning towards a third profile portion.

13 Claims, 2 Drawing Sheets

(56) References Cited

U.S. PATENT DOCUMENTS

| | | | | |
|---|---|---|---|---|
| 8,733,782 | B2 | 5/2014 | Smith | |
| 2005/0104331 | A1* | 5/2005 | Papon | A63C 10/06 280/619 |
| 2007/0096411 | A1* | 5/2007 | Rempe | A63C 10/06 280/32.5 |
| 2018/0229102 | A1 | 8/2018 | Harris | |
| 2019/0247736 | A1 | 8/2019 | Massey | |
| 2021/0031093 | A1* | 2/2021 | Pascal | A43B 5/04 |

FOREIGN PATENT DOCUMENTS

| | | | | |
|---|---|---|---|---|
| FR | 2818156 | A1 * | 6/2002 | A63C 13/001 |
| WO | WO-2012060710 | A1 * | 5/2012 | A63C 13/005 |
| WO | WO-2022180303 | A1 * | 9/2022 | A63C 9/22 |

OTHER PUBLICATIONS

WO-2012060710-A1 English Translation (Year: 2012).*
DE-102014000830-A1 English Translation (Year: 2015).*
FR-2774302-A1 English Translation (Year: 1999).*
WO-2022180303-A1 English Translation (Year: 2022).*
International Search Report and Written Opinion for corresponding International application No. PCT/FI2022/050113 (10 pages).

* cited by examiner

SKI OR SNOWSHOE BINDING

CROSS-REFERENCE TO RELATED APPLICATIONS

This application is a national phase entry of, and claims priority to, International Patent Application No. PCT/FI2022/050113 (filed 21 Feb. 2022), which claims priority to Finnish Patent Application No. U20210025 (filed 24 Feb. 2021), the entire disclosures of which are incorporated herein by reference.

BACKGROUND

Technical Field

The invention relates to a ski or snowshoe binding, to which a normal boot is attachable with general attachments which are part of said binding, such as with a strap in a front part of the binding and with a strap arrangement in a back part of the binding, and whereby the strap of the front part of the binding is transverse to the binding, adjustable in length and extends in a toe part of the binding under the body or inside the body of the binding.

Discussion of Art

A disadvantage of the above-described front straps extending over a front part of the boot has been excessive stiffness as the strap comes out from both sides of the body of the binding and turns up. The strap extends under or in the binding in a slot quite accurately matching its size, whereby it is not able to twist or bend at the binding. When the strap has been e.g., pre-moulded to have a curved portion for the strap to rise up from the binding, it becomes very stiff and because of this, the strap is also stiff in the parts where it crosses over the front part of the boot, while also pressing the boot to some degree, and tends to prevent the boot from moving.

During skiing, the heel part of the boot is lifted off the ski, and when the binding further includes a hinge allowing the body of the binding to fold, the front part of the boot tends to slightly move under the front strap. If the front strap does not move at all, the boot will be subject to wearing, or breakages of the front strap will occur due to torsion.

BRIEF DESCRIPTION

To solve the disadvantage and problem described above, a new front strap structure has been developed, whereby the disadvantages of the known front straps and their damaging are avoided. With the front strap according to the invention, a substantial improvement is achieved over the current known state of the art, and a front strap that is capable of the necessary elasticity and is also durable in use can now be presented. The front strap according to the invention is characterized in that the cross-sectional profiles of the strap of the front part have been made in such a way that as the strap comes out from the body and turns upwards, a first profile portion is, over this distance, in a direction of width at its narrowest substantially in the entire upward turn, after which a second profile portion is widening and thinning towards a third profile portion, the third profile portion is edge-reinforced.

It can be considered an advantage of the front strap according to the invention that, by means of the variations in the cross-sectional profile made therein, the front strap is caused to sufficiently bend and/or twist right after it comes out from the body of the binding. Due to these properties, the front strap may move over the front part of the boot for the necessary small distance when, during skiing, the heel part of the boot is lifted up from the ski.

A first configuration may comprise a ski or snowshoe binding, to which binding a normal boot is attachable with general attachments which are part of said binding, such as with a strap in a front part of the binding and with a strap arrangement in a back part of the binding, and whereby the strap of the front part of the binding may be transverse to the binding, adjustable in length and may extend in a toe part of the binding under the body or inside the body of the binding, the cross-sectional profiles of the strap of the front part may have been made in such a way that as the strap comes out from the body and turns upwards, a first profile portion may be, over this distance, in a direction of width at its narrowest substantially in the entire upward turn, after which a second profile portion may be widening and thinning towards a third profile portion.

According to an example embodiment of the first configuration, the first profile portions and the second profile portions of the strap may be in substantially similar ways as a mirror image on both sides of the binding.

According to an example embodiment of the first configuration, the narrowest first profile portion may be in width between 40-60% of the wider third profile portion.

According to an example embodiment of the first configuration, a length of the second profile portion between the first profile portion and the third profile portion may be 20-40% of a length of the first profile portion.

According to an example embodiment of the first configuration, the strap may be elastic.

According to an example embodiment of the first configuration, in the area of the first profile portion the strap may be adapted to twist.

According to an example embodiment of the first configuration, the strap may be U-shaped.

According to an example embodiment of the first configuration, the strap may be arranged to be manufactured with one mould.

According to an example embodiment of the first configuration, a width of the first profile portion may be smaller than a width of the middle part, a width of the second profile portion and/or a width of the third profile portion; and/or a height of the first profile portion may be greater than a height of the second profile portion and/or a height of the third profile portion.

According to an example embodiment of the first configuration, a cross-sectional shape (A-A) of the first profile portion may be oval.

According to an example embodiment of the first configuration, the third profile portion may be edge-reinforced or edge-chamfered.

According to an example embodiment of the first configuration, the strap may comprise an initial part of the strap, a middle part of the strap and a terminal part of the strap, wherein the initial part of the strap comprises the first profile portion, the second profile portion and the third profile portion, and the terminal part of the strap comprises the first profile portion, the second profile portion and a fourth profile portion.

According to an example embodiment of the first configuration, the fourth profile portion may comprise at least one of the following: a formation, a hole and/or a lightening feature.

According to an example embodiment of the first configuration, the middle part of the strap may comprise at least one locking recess.

According to an example embodiment of the first configuration, the initial part of the strap comprises an end part.

BRIEF DESCRIPTION OF THE DRAWINGS

In the following, the invention will be explained in more detail with reference to the accompanying drawings, in which.

DETAILED DESCRIPTION

Figure 1:
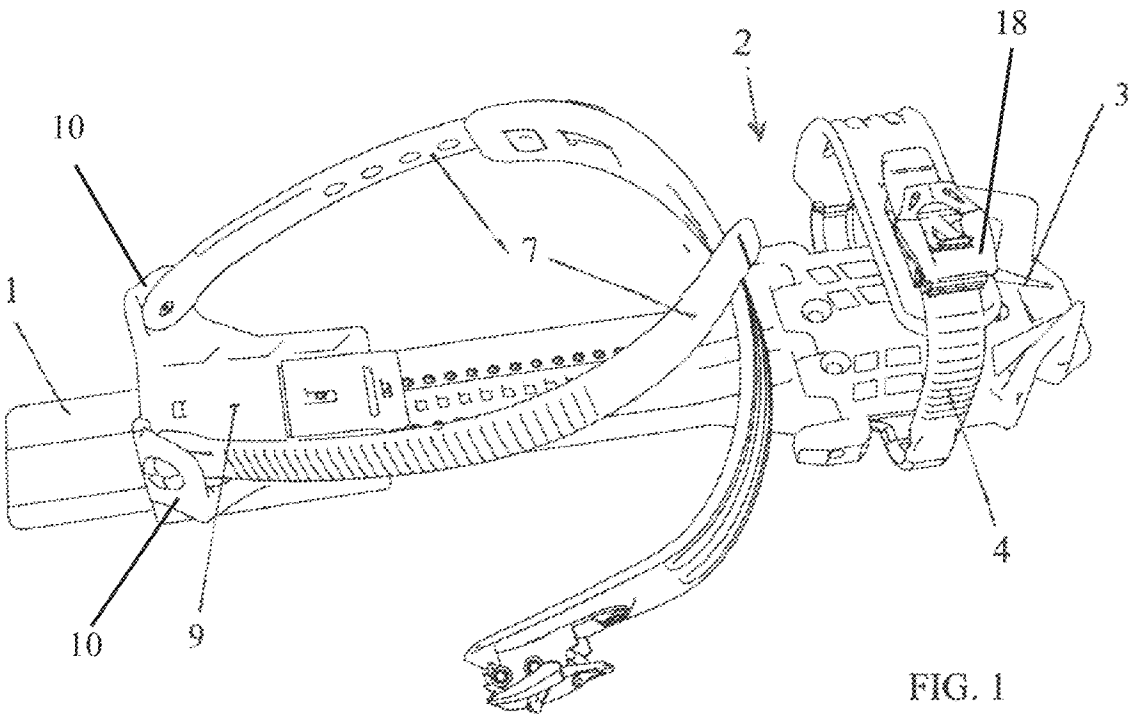
FIG. 1 illustrates one strap-attachable ski binding as an oblique side view.

FIG. 1 illustrates one binding 2 according to the invention, comprising a front part with a transverse strap 4 forming a loop into which a front part of a boot is fitted. A base part 1 of the binding functions as a body of the binding and the front part is connected thereto by means of a hinge. A back part 9 of the binding 2 is movable over the base part 1 and lockable thereto. The back part 9 comprises lugs 10 to which strap arrangements 7 of the back part are connected at ends thereof. The strap arrangements 7 include length adjustment means.

Figure 2:
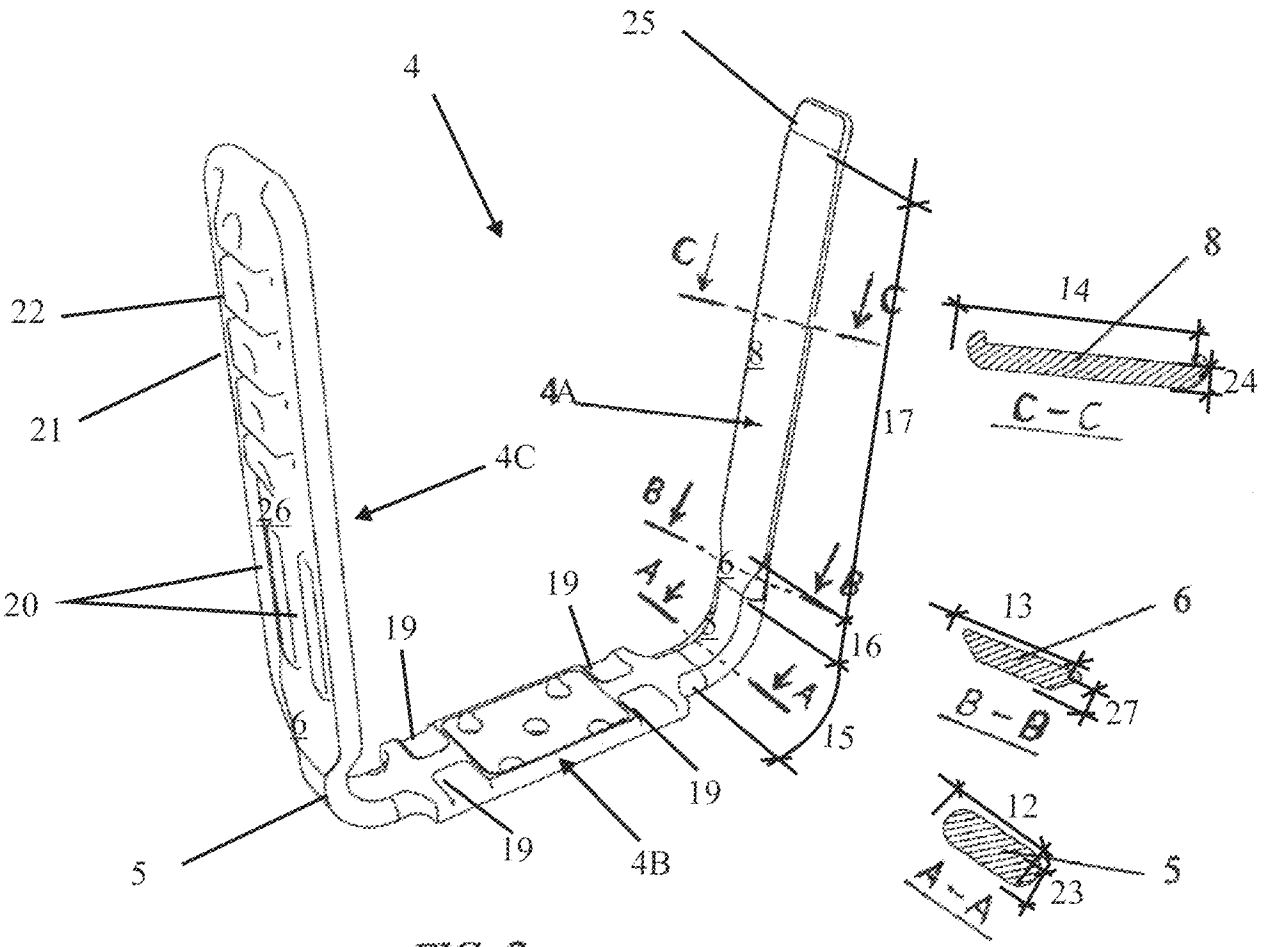
FIG. 2 illustrates a front strap and different cross-sectional profile shapes thereof.

FIG. 2 illustrates the front strap 4 as a simplified view. A toe part 3 of the binding 2 extends over the strap 4, whereby either the strap 4 is disposed between the ski and the binding body or the binding body comprises a through hole for the strap 4. FIG. 2 illustrates a configuration according to the invention, whereby as the strap comes out from the binding body or from thereunder, the profile of the binding changes to a narrower first profile portion 5, of which profile portion it is for the distance of the upward turn. After that, in a vertical direction, the profile momentarily widens as well as thins as a second profile portion 6, until it continues as a third profile portion 8 with outward edge reinforcements.

Especially in the area of the first profile portion 5 the strap 4 is able to twist, which provides the strap 4, while it rests on the boot, with a possibility to move forward and backward to some extent, which is necessary. The profile portions of the strap 4: the first 5, the second 6 and the third 8 are symmetrically similar at least as far as the first 5 and the second profile portions 6 are concerned on both sides of the binding 2. The first profile portion 5 which is the narrowest one of the profile portions is in width approximately 40-60% of the wider third profile portion 8. Further, a length 16 of profile portion 6 between the first profile portion 5 and the third profile portion 8 is 20-40% of a length 15 of the first profile portion 5.

As illustrated in the example of FIG. 2, the strap 4 comprises an initial part 4A of the strap, a middle part 4B of the strap and a terminal part 4C of the strap. The initial part 4A of the strap, the middle part 4B of the strap and the terminal part 4C of the strap may connect seamlessly to each other. The strap 4 may comprise one single piece. The strap 4 may be manufactured with one mould. The strap may be substantially U-shaped as seen from the front. The initial part 4A and the terminal part 4C of the strap may curve at both sides from the middle part 4B in an upward direction when the strap 4 is for example attached to the binding 2. The angle between the initial part 4A and the middle part 4B of the strap may vary for example between approximately 70°-110° and may preferably be approximately 90°. Similarly, the angle between the locking part 4C and the middle part 4B may vary for example between approximately 70°-110° and may preferably be approximately 90°.

According to one example embodiment, the initial part 4A of the strap may comprise the first profile portion 5, the second profile portion 6 and the third profile portion 8. The first and the second profile portion 5, 6 may be on both sides of the middle part 4B as mirror images. The second profile portion 6 is between the first and the third profile portion 5, 8 in the initial part 4A. In addition, the initial part 4A of the strap may comprise an end part 25. The end part 25 may comprise a thinned and slightly rounded end of the strap 4 to facilitate insertion of the strap 4 into a locking part 18. All the profile portions 5, 6, 8 may connect seamlessly to each other. In addition, the end part 25 may connect seamlessly to the third profile portion 8.

The first profile portion 5 may continue directly from the middle part 4B and may comprise a curved portion curving along the entire length 15 of the first profile portion 5 in an upward direction in such a way that the initial part 4A of the strap points substantially upwards from the ski in a use position of the binding 2. The initial part 4A and the terminal part 4B of the strap may both comprise the first and the second profile portion 5, 6 that may be situated as a mirror image at both sides of the binding 2.

According to one example embodiment, a width 12 of the first profile portion 5 is smaller than a width of a cross-section of the middle part 4B, a width 13 of the second profile portion and/or a width 14 of the third profile portion. Additionally, a height 23 of the first profile portion may be greater than a height 27 of the second profile portion and/or a height 24 of the third profile portion. The first profile portion 5 may have a constant height and width, whereby the height and width thereof do not change. The first profile portion 5 may be thicker and narrower than the other parts of the strap 4. This may enable the strap 4 to not easily break even if it is twisted and bent in both lateral and vertical directions. Thus, the narrow first profile portion 5 hinges and turns more easily than the other profile portions of the strap 4. Additionally, the strength properties of the thicker first profile portion 5 are better than those of the thinner profile portions of the strap 4, whereby it does not snap easily. According to one example embodiment, a cross-sectional shape A-A of the first profile portion 5 is substantially oval-shaped.

The second profile portion 6 may continue seamlessly from the first profile portion 5 along the length 16 of the second profile portion 6. The second profile portion 6 may begin at a point where the strap 4 begins to widen and thin and it may end at the third profile portion 8. A cross-sectional shape B-B of the second profile portion 6 may be gradually or by degrees thinning from the cross-sectional shape A-A of the first profile portion towards a cross-sectional shape C-C of the third profile portion 8. The cross-sectional shape B-B of the second profile portion 6 may be gradually or by degrees widening from the cross-sectional shape A-A of the first profile portion towards the cross-sectional shape C-C of the third profile portion 8. The third profile portion 8 may continue without a seam from the second profile portion 6 along a length 17 of the third profile portion 8. A width 14 of the third profile portion may remain the same for the entire length 17 of the third profile portion. A thickness of the third profile portion may also remain the same for the entire length 17 of the third profile portion.

The width 13 of the second cross-sectional shape may be greater than the width 12 of the first cross-sectional shape. Additionally, the height 27 of the second cross-sectional shape may be smaller than the height 23 of the first cross-sectional shape. The second cross-sectional shape B-B may be a trapezium. The width 14 of the third cross-sectional shape may be greater than the width 12, 13 of the first and/or the second cross-sectional shape and the height 24 of the third cross-sectional shape may be smaller than the height 23, 27 of the first and/or the second cross-sectional shape. According to one example embodiment, the third profile portion is edge-reinforced or edge-chamfered.

According to one example embodiment, a fourth profile portion 26 comprises at least one of the following: a formation 21, a hole 22 and/or a lightening feature 20. The formation 21 may comprise outwardly extending protrusions in the middle of which there may be at least one hole 22. The formation 21 may enable attachment of the locking part 18 to the terminal part 4C of the strap as illustrated in the example of FIG. 1. When locking the binding 2, the initial part 4A of the strap may be inserted into the locking part 18 and tightened. The initial part 4A of the strap may also comprise a toothing or toothed step arrangement on a surface thereof to facilitate the locking. By means of the at least one hole 20, the locking part 18 may be attached to the formation part 21 in a releasable and adjustable way. Thus, the position of the locking part 18 may be easily varied. At least one lightening feature 20 may comprise at least one hole or thinning. The lightening feature may facilitate the bending of the strap 4 over the boot.

According to one example embodiment, the middle part 4B of the strap comprises at least one locking recess 19. The locking recess 19 may enable attachment of the strap 4 to the front part of the binding 2. In the front part of the binding there may be at least one locking pin that is pushed into the at least one locking recess 19. This may enable attachment of the strap 4 to the binding 2 such that it will not be able to move under the binding 2 and come off.

What is claimed is:

1. A ski or snowshoe binding configured to attach to a boot, the binding comprising:

a body;

a strap in a front part of the body; and a strap arrangement in a back part of the body, the strap of the front part of the body transverse to the body, adjustable in length, and extending in a toe part of the binding under the body or inside the body, wherein cross-sectional profiles of the strap of the front part have a first profile portion that has a narrowest cross-sectional profile in an entire upward turn of the strap as the strap comes out from the body and turns upward, a second profile portion having a cross-sectional profile that widens and then thins toward a third profile portion or a fourth profile portion, and wherein a width of the first profile portion is smaller than one or more of: a width of a middle part of the strap, a width of the second profile portion, or a width of the third profile portion; or a height of the first profile portion is greater than one or more of: a height of the second profile portion or a height of the third profile portion.

2. The ski or snowshoe binding according to claim 1, wherein the first profile portion and the second profile portion on a first side of the binding are mirror images of a first profile and second profile on a second side of the binding.

3. The ski or snowshoe binding according to claim 1, wherein the first profile portion has a width that is between 40-60% of the third profile portion.

4. The ski or snowshoe binding according to claim 1, wherein a length of the second profile portion that extends from the first profile portion to the third profile portion is 20-40% of a length of the first profile portion.

5. The ski or snowshoe binding according to claim 1, wherein the strap is elastic.

6. The ski or snowshoe binding according to claim 1, wherein the strap is adapted to twist in the first profile portion.

7. The ski or snowshoe binding according to claim 1, wherein the strap is U-shaped.

8. The ski or snowshoe binding according to claim 1, wherein the first profile portion of the strap has an oval shape.

9. The ski or snowshoe binding according to claim 1, wherein the third profile portion has reinforced edges or chamfered edges.

10. The ski or snowshoe binding according to claim 1, wherein the strap comprises an initial part of the strap, the middle part of the strap, and a terminal part of the strap, wherein the initial part of the strap comprises the first profile portion, the second profile portion, and the third profile portion; and the terminal part of the strap comprises the first profile portion, the second profile portion, and the fourth profile portion of the strap.

11. The ski or snowshoe binding according to claim 10, wherein the fourth profile portion comprises at least one of: a hole, or a lightening feature.

12. The ski or snowshoe binding according to claim 10, wherein the middle part of the strap comprises at least one locking recess.

13. The ski or snowshoe binding according to claim 10, wherein the initial part of the strap comprises an end part.

* * * * *